US007393183B2

(12) United States Patent
Keller

(10) Patent No.: US 7,393,183 B2
(45) Date of Patent: Jul. 1, 2008

(54) TRAILING EDGE ATTACHMENT FOR COMPOSITE AIRFOIL

(75) Inventor: Douglas A. Keller, Kalamazoo, MI (US)

(73) Assignee: Siemens Power Generation, Inc., Orlando, FL (US)

( * ) Notice: Subject to any disclaimer, the term of this patent is extended or adjusted under 35 U.S.C. 154(b) by 428 days.

(21) Appl. No.: 11/156,196

(22) Filed: Jun. 17, 2005

(65) Prior Publication Data

US 2006/0285973 A1 Dec. 21, 2006

(51) Int. Cl.
*F01D 5/14* (2006.01)

(52) U.S. Cl. ..... 416/224; 416/223 A

(58) Field of Classification Search ..... 416/224, 416/62, 223 A, 248; 29/889.21
See application file for complete search history.

(56) References Cited

U.S. PATENT DOCUMENTS

| | | | | |
|---|---|---|---|---|
| 1,939,357 | A | 12/1933 | Lorenzen | |
| 3,215,511 | A * | 11/1965 | Chisholm et al. | 29/889.21 |
| 4,026,659 | A | 5/1977 | Freeman, Jr. | |
| 4,565,490 | A | 1/1986 | Rice | |
| 4,728,262 | A * | 3/1988 | Marshall | 416/224 |
| 5,306,120 | A | 4/1994 | Hammer et al. | |
| 5,337,805 | A | 8/1994 | Green et al. | |
| 5,358,379 | A | 10/1994 | Pepperman et al. | |
| 5,785,498 | A | 7/1998 | Quinn et al. | |
| 6,200,092 | B1 | 3/2001 | Koschier | |
| 6,305,903 | B1 * | 10/2001 | Semmler et al. | 416/97 R |
| 6,325,593 | B1 | 12/2001 | Darkins, Jr. et al. | |
| 6,514,046 | B1 | 2/2003 | Morrison et al. | |
| 6,637,500 | B2 | 10/2003 | Shah et al. | |
| 6,648,596 | B1 | 11/2003 | Grylls et al. | |
| 6,709,230 | B2 | 3/2004 | Morrison et al. | |
| 2004/0020629 | A1 | 2/2004 | Shah et al. | |
| 2004/0202542 | A1 | 10/2004 | Cunha et al. | |

FOREIGN PATENT DOCUMENTS

| | | |
|---|---|---|
| DE | 44 11 679 C1 | 12/1994 |
| EP | 1 489 264 A1 | 12/2004 |

* cited by examiner

*Primary Examiner*—Richard Edgar

(57) ABSTRACT

A trailing edge attachment for a composite turbine airfoil. The trailing edge attachment may include an attachment device for attaching the trailing edge attachment to the airfoil. The attachment device may include a plurality of pins extending through the attachment device and into the trailing edge blade. The trailing edge attachment may also include a spanwise cooling channel for feeding a plurality of cooling channels extending between a leading edge of the trailing edge attachment and a trailing edge of the attachment device. The attachment device may be configured to place the leading edge of the composite airfoil in compression, thereby increasing the strength of the composite airfoil.

19 Claims, 3 Drawing Sheets

TRAILING EDGE ATTACHMENT FOR COMPOSITE AIRFOIL

FIELD OF THE INVENTION

This invention is directed generally to turbine airfoils, and more particularly to trailing edge systems for composite turbine airfoils.

BACKGROUND

Turbine airfoils are exposed to high temperature environments within operating turbine engines. Conventional turbine airfoils have been formed from metals and have included internal cooling systems for routing cooling fluids, such as air, through the turbine airfoils to maintain the turbine airfoil within acceptable temperature limits. These internal cooling systems have evolved over time from simplistic systems to very complex cooling systems in an effort to increase the efficiency of the turbine engine. While the efficiency of internal cooling systems has been increased, turbine airfoils formed from heat tolerant composite materials have been introduced as an alternative. For instance, turbine airfoils have been formed from ceramic materials, such as, but not limited to, ceramic matrix composite (CMC), and other such materials. Ceramics can handle high temperature environments without damage but lack the strength and formability of metals.

Use of ceramics in forming turbine airfoils limits the ability to create an aerodynamic trailing edge. More specifically, a ceramic matrix can not be formed into a thin edge, as commonly found in conventional metal turbine airfoils. Rather, a trailing edge of a ceramic turbine airfoil often has a blunt shape. Trailing edge attachments have been developed from other materials, such as conventional metals used to form turbine airfoils, and attached to the trailing edge of a composite airfoil to reduce the aerodynamic losses associated with a blunt shaped trailing edge.

SUMMARY OF THE INVENTION

This invention is directed to a trailing edge attachment for a turbine airfoil such as, but not limited to, a composite airfoil. The trailing edge attachment is usable to form an aerodynamic trailing edge on a turbine airfoil. The trailing edge attachment may be formed from a generally elongated body having a suction side surface adapted to be positioned flush with a suction side surface of a turbine airfoil, a pressure side surface adapted to be positioned flush with a pressure side surface of the turbine airfoil, and a leading edge of the body formed by an elongated cavity defining the leading edge of the body, wherein the elongated cavity is configured to receive at least a portion of the turbine airfoil. The cavity may be sized such that strength of the airfoil is not compromised when the trailing edge attachment is attached to the turbine airfoil.

The trailing edge attachment may also include an attachment device adapted to attach the generally elongated body to the turbine airfoil. The attachment device may include, but is not limited to, one or a plurality of pins that extend from a suction side or pressure side surface of the trailing edge attachment and into the turbine airfoil. An attachment support may be positioned within an inner cavity in the airfoil and proximate to an inner surface of the airfoil to support attachment of the elongated body to the airfoil. The inner cavity in the turbine blade may be used to supply cooling fluids to a cooling system of the trailing edge attachment. The cooling system may have any configuration capable of adequately cooling the trailing edge attachment. For instance, the cooling system may be formed from a plurality of cooling channels extending between a leading edge of the trailing edge attachment and a trailing edge of the trailing edge attachment, may be formed from a plurality of pedestals in a cooling channel, or may be formed from other appropriate configurations.

The trailing edge attachment may also include a suction side securement device positioned in the generally elongated body proximate to the suction side surface of the generally elongated body and adapted to receive an outer wall of the turbine airfoil forming the suction side surface of the turbine airfoil. The trailing edge attachment may also include a pressure side securement device positioned in the generally elongated body proximate to the pressure side surface of the generally elongated body and adapted to receive an outer wall of the turbine airfoil forming the pressure side surface of the turbine airfoil. An attachment device may be used to attach the generally elongated body to the turbine airfoil. The trailing edge attachment may be configured such that a distance from the suction side surface of the airfoil to the pressure side surface of the airfoil is greater than a distance from an outermost inlet surface of the suction side securement device of the generally elongated body to an outermost inlet surface of the pressure side securement device of the generally elongated body. Such a configuration creates an interference fit between the turbine airfoil and the trailing edge attachment. The trailing edge attachment may be installed on the turbine airfoil by pinching the outer walls forming the turbine airfoil together. The trailing edge attachment may then be inserted onto the turbine airfoil by directing the suction side outer wall of the turbine airfoil into the suction side securement device and by directing the pressure side outer wall of the turbine airfoil into the pressure side securement device.

An advantage of this invention is that the interference fit created between the outer walls of the turbine airfoil and the trailing edge attachment places the leading edge of the airfoil into compression, which greatly strengthens composite turbine airfoils. Specifically, the interference fit strengthens composite turbine airfoils, such as ceramic matrix composites.

Another advantage of this invention is that the trailing edge attachment includes a spanwise cooling channel that supplies cooling fluids to the cooling system located within the trailing edge attachment.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
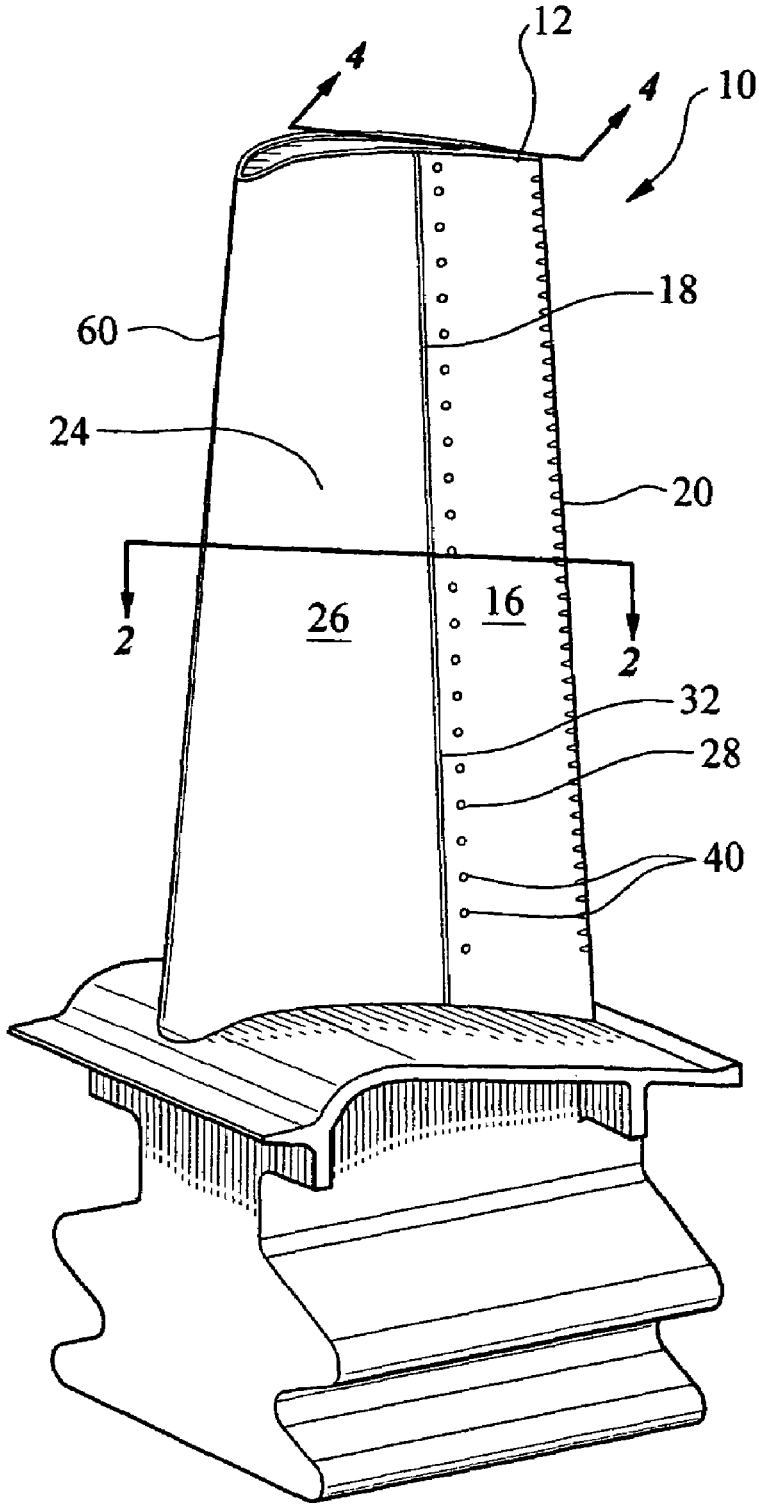
FIG. 1 is a perspective view of a turbine airfoil including aspects of the invention.

As shown in FIGS. 1-5, this invention is directed to a trailing edge attachment 10 usable to form an aerodynamic trailing edge on a turbine airfoil 24, such as a composite airfoil. The trailing edge attachment 10 may be formed from a generally elongated body 12 having a suction side surface 14, a pressure side surface 16, a leading edge 18, and a trailing edge 20. In embodiments in which the trailing edge attachment 10 is attached to a composite airfoil 24, the trailing edge attachment 10 may be adapted to taper to the trailing edge 20 to reduce drag on the suction and pressure side surfaces 14, 16. In at least one embodiment, the trailing edge attachment 10 is configured to be attached to a composite airfoil 24 formed, at least in part, from a ceramic matrix composite (CMC).

The generally elongated body 12 forming the trailing edge attachment 10 may extend along all or a portion of a trailing edge 20 of the turbine airfoil 24. The generally elongated body 12 forming the trailing edge attachment 10 may also be appropriately sized to mate with the turbine airfoil 24 to which the body 12 is to be mounted. In at least one embodiment, the suction side surface 14 of the trailing edge attachment 10 may be adapted to be positioned substantially flush with a suction side surface 22 of a turbine airfoil 24. Similarly, the pressure side surface 16 of the trailing edge attachment may be adapted to be positioned substantially flush with a pressure side surface 26 of the turbine airfoil 24.

Figure 2:
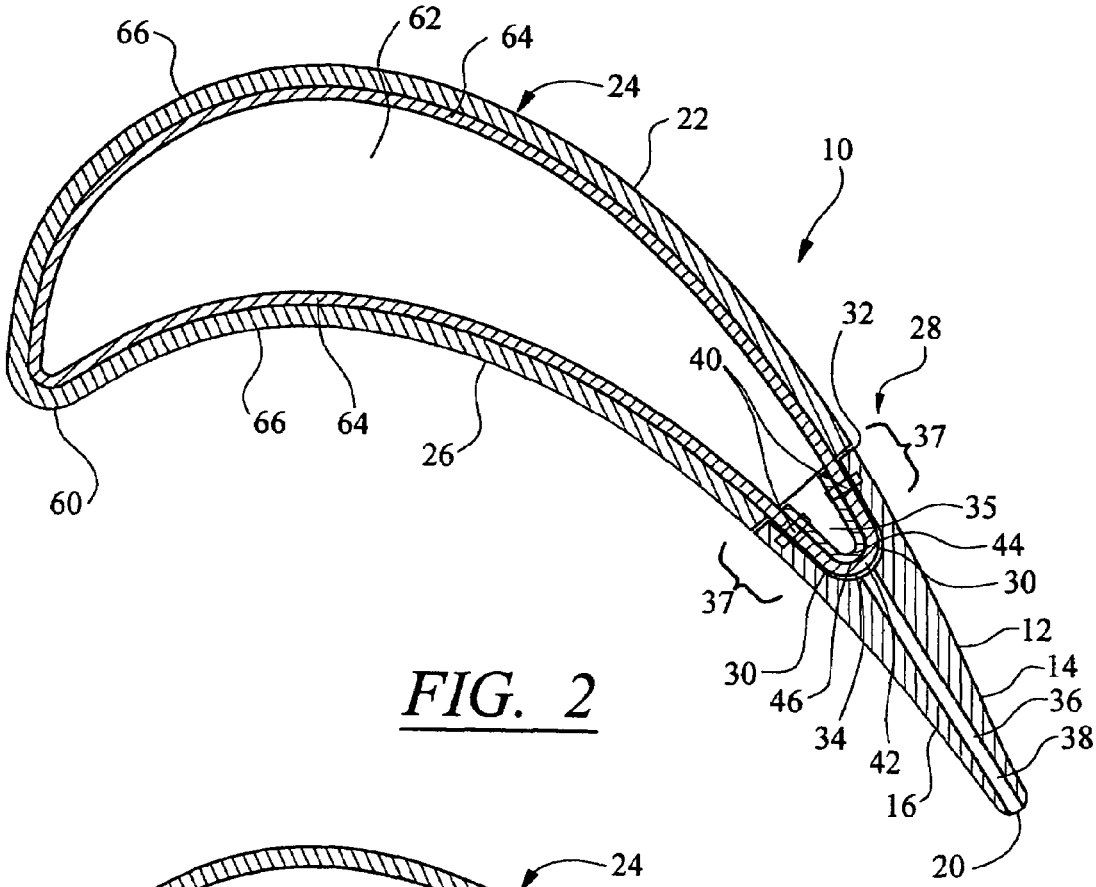
FIG. 2 is a cross-sectional view taken at section line 2-2 in FIG. 1 and depicts the trailing edge attachment of this invention.

As shown in FIG. 2, the leading edge 18 of the generally elongated body 12 may include an elongated cavity 34 extending generally spanwise in the body 12 that defines the leading edge 18 of the body 12. The elongated cavity 34 may be adapted to receive at least a portion of the turbine airfoil 24. As shown in FIG. 2, the elongated cavity 34 may have a generally U-shaped cross-section. The elongated cavity 34 may extend sufficiently into the body 12 such that an attachment device 28 used to attach the body 12 to the turbine airfoil 24 may not protrude into any portion of the curved region 30 of a trailing edge 32 of the turbine airfoil 24. Rather, the attachment device 28 may protrude through a substantially flat surface 37. In embodiments in which the turbine airfoil 24 is formed from CMC, penetrating the CMC through the curved region is likely to weaken the trailing edge 32 of the turbine airfoil 24. Thus, the elongated cavity 34 may extend into the body 12 a distance sufficient to allow the attachment device 28 to protrude into the turbine airfoil 24 at locations other than in the curved region 30 of the trailing edge 32.

The elongated cavity 34 may be adapted to receive cooling fluids, such as, but not limited to, air, from the turbine airfoil 24 and to pass the cooling fluids into a cooling system 36 in the trailing edge attachment 10. The elongated cavity 34 may extend along all of or along only a portion of the trailing edge attachment 10. In addition, the elongated cavity 34 may extend uninterrupted or be formed from a plurality of segments.

The cooling system 36 in the trailing edge attachment 10 may be formed from any appropriate configuration capable of removing heat from the attachment device 10 and maintaining a temperature of the device 10 within an acceptable range. In at least one embodiment, as shown in FIGS. 2-5, the cooling system 36 may be formed from a plurality of cooling channels 38 extending generally chordwise from the leading edge 18 of the body 12 to the trailing edge 20 of the body 12. The cooling channels 38 may be spaced equally or otherwise. In another configuration, as shown in FIG. 4, the cooling system 36 may be formed from a cooling channel 38 having a plurality of pedestals 70 positioned within the channel 38 to increase the convection in the channel 38. The cooling system 36 may be formed from one or more cooling channels 38 having pedestals 70.

Figure 5:
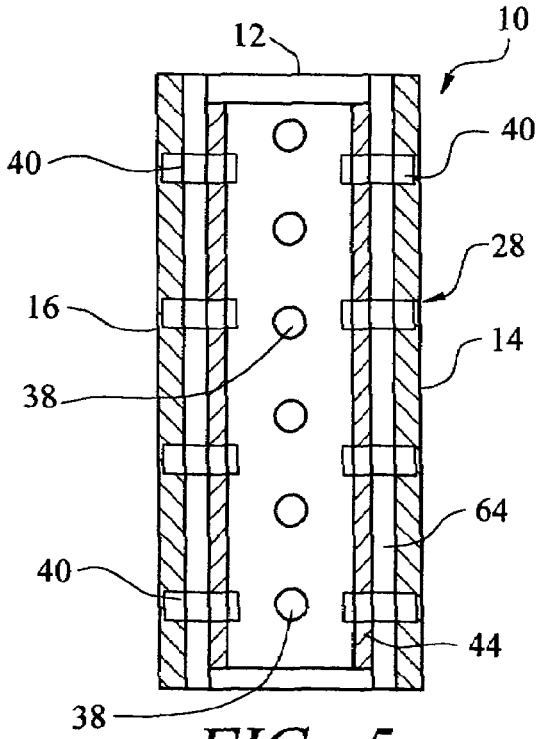
FIG. 5 is a cross-sectional view of the trailing edge attachment of this invention taken at section line 5-5 in FIG. 4.

The trailing edge attachment device 10 may also include the attachment device 28 adapted to attach the generally elongated body 12 to the turbine airfoil 24. The attachment device 28 may be formed from any device capable of attaching the turbine edge attachment device 10 to the turbine airfoil 24 without unduly compromising the strength of the trailing edge 32 of the turbine airfoil 24. As shown in FIGS. 2 and 5, the attachment device 10 may be formed from one or more pins 40 extending through a portion of the leading edge 18 of the body 12 and into the turbine airfoil 24. In at least one embodiment, the pins 40 may extend from a suction side surface 14 of the body 12, through a portion of the body 12, and into the turbine airfoil 24. Similarly, the pins 40 may extend from a pressure side surface 16 of the body 12, through a portion of the body 12, and into the turbine airfoil 24. The pins 40 may be positioned at an equal distant from each other or otherwise.

As shown in FIG. 2, an attachment support 44 may be included to attach the trailing edge attachment 10 to the turbine airfoil 24. The attachment support 44 may be configured to fit within a cavity 35 in the turbine airfoil 24 proximate to an outer wall 42 of the turbine airfoil 24 and configured to receive the attachment device 28 extending through the outer wall 42 of the turbine airfoil 24. The attachment support 44 may be configured to fit closely with the inner surface 46 of the outer wall 42, as shown in FIG. 2. In at least one embodiment, the attachment support 44 may have a generally U-shaped cross-section. The attachment support 44 may be formed of materials such as, but not limited to, metal super alloys typically used in airfoil fabrication.

The turbine airfoil 24 may be formed from metal or composite materials. In at least one embodiment, as shown in FIG. 2, the turbine airfoil 24 may be formed from a central core 62 and an outer ceramic matrix composite layer 64. The outer ceramic matrix composite layer 64 may be covered with a thermal boundary coating 66. The trailing edge attachment 10 may be formed from of materials such as, but not limited to, metal super alloys typically used in airfoil fabrication, including, but not limited to, directionally solidified (DS) and single crystal alloys.

Figure 3:
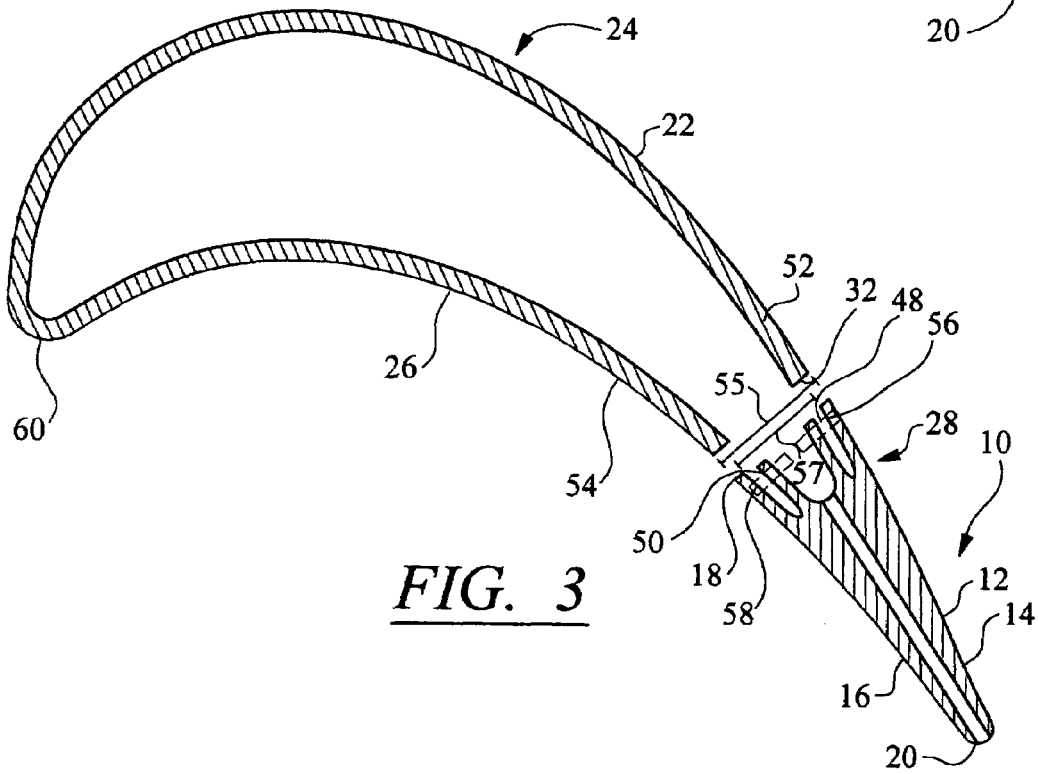
FIG. 3 is a cross-sectional view depicting an alternative configuration of the trailing edge attachment of this invention that is viewed from the same perspective as FIG. 2.
Figure 4:
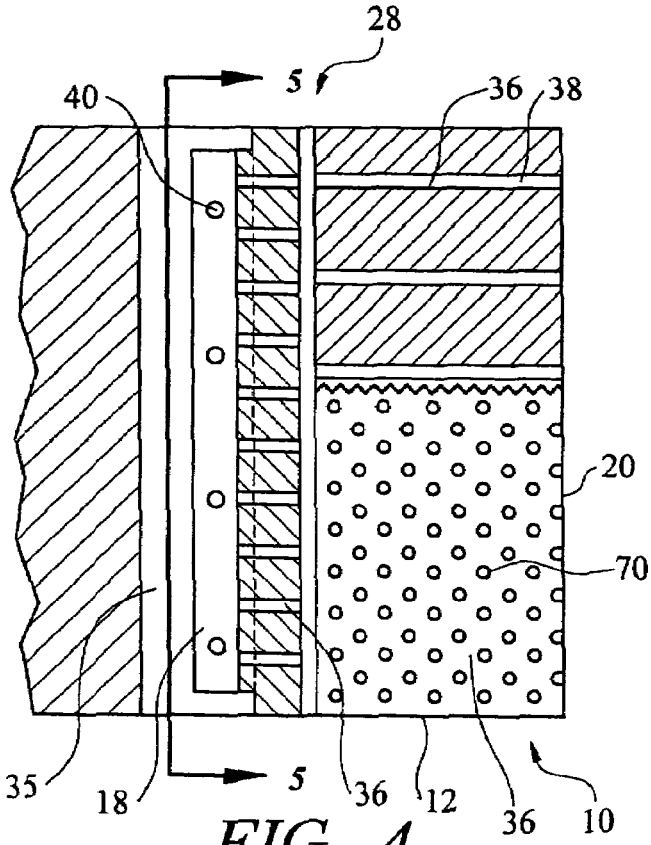
FIG. 4 is a cross-sectional view of the trailing edge attachment of this invention taken at section line 4-4 in FIG. 2.

In an alternative embodiment, as shown in FIG. 3, the trailing edge attachment 10 may have a leading edge 18 with an alternative configuration. The leading edge 18 may be configured to include a suction side securement device 48 and a pressure side securement device 50. The suction side securement device 48 may be positioned in the generally elongated body 12 proximate to the suction side surface 14 of the generally elongated body 12 and adapted to receive a suction side outer wall 52 of the turbine airfoil 24. The pressure side securement device 50 may be positioned in the generally elongated body 12 proximate to the pressure side surface 16 of the generally elongated body 12 and adapted to receive a pressure side outer wall 54 of the turbine airfoil 24. In this embodiment, the distance 55 between the suction side surface 22 and the pressure side surface 26 of the turbine airfoil 24 is greater than a distance 57 from an outermost inlet surface 56 of the suction side securement device 48 of the generally elongated body 12 to an outermost inlet surface 58 of the pressure side securement device 50 of the generally elongated body 12. Thus, the suction side or pressure side outer walls 52, 54, or both, must be moved toward the other to decrease the distance 55 between the suction side surface 22 and the pressure side surface 26 of the turbine airfoil 24. The suction side and pressure side outer walls 52, 54 are inserted into the suction side and pressure side securement devices 48, 50, respectively, and released. The resulting interference fit between the suction side and pressure side outer walls 52, 54 and the turbine airfoil 24 advantageously causes a leading edge 60 of the turbine airfoil 24 to be placed into compression. Placing the leading edge 60 of the turbine airfoil 24 into compression advantageously increases the strength of the CMC airfoil 24.

This invention includes a method for attaching the trailing edge attachment 10 to a composite turbine airfoil 24. The method includes providing the composite turbine airfoil 24 and the trailing edge attachment 10. The trailing edge 32 of the composite turbine airfoil 24 may be inserted into the elongated cavity 34 in the leading edge 18 of the trailing edge attachment 10. The trailing edge attachment 10 may be attached to the composite turbine airfoil 24 using the attachment device 28. In at least one embodiment, the attachment device 28 may include inserting the pins 40 through the suction side and pressure side surfaces 14, 16 of the trailing edge attachment 10 and into turbine airfoil 24. Cooling fluids may be supplied to the trailing edge cooling system 36 from the cooling channels in the turbine airfoil 24. Cooling fluids may collect in the cavity 35 and be distributed to the cooling system 36. The cooling fluids reduce the temperature of the trailing edge attachment 10.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A trailing edge attachment for a turbine airfoil, comprising: a generally elongated body having a suction side surface adapted to be positioned flush with a suction side surface of a turbine airfoil, a pressure side surface adapted to be positioned flush with a pressure side surface of the turbine airfoil, and a leading edge of the body formed by an elongated spanwise cavity defining the leading edge of the body; and an attachment device adapted to attach the generally elongated body to the turbine airfoil, wherein the attachment device includes a plurality of pins that extend through portion of the generally elongated body and into the turbine airfoil; and wherein the elongated cavity is configured to receive at least a portion of the turbine airfoil such that the attachment device is adapted to contact the body through a flat surface.

2. The trailing edge attachment of claim 1, further comprising an attachment support that is configured to fit within a cavity in the turbine airfoil and proximate to an outer wall of the turbine airfoil and configured to receive the attachment device extending through the outer wall of the turbine airfoil.

3. The trailing edge attachment of claim 2, wherein said plurality of pins extends through the attachment support.

4. The trailing edge attachment of claim 3, wherein the plurality of pins are welded to the attachment support.

5. The trailing edge attachment of claim 2, wherein the attachment support has a generally U-shaped cross-section adapted to fit within the inner cavity in the turbine airfoil and in contact with the outer wall of the turbine airfoil proximate to a trailing edge of the turbine airfoil.

6. The trailing edge attachment of claim 5, wherein the turbine airfoil is formed from a composite airfoil having an inner core covered by a ceramic matrix composite, wherein the ceramic matrix composite extends from the inner core to form the inner cavity in the turbine airfoil at the trailing edge of the generally elongated body.

7. The trailing edge attachment of claim 1, further comprising a cooling system positioned in the generally elongated body.

8. The trailing edge attachment of claim 7, wherein the cooling system comprises a plurality of cooling channels extending from the leading edge of the generally elongated body to a trailing edge of the trailing edge attachment.

9. A trailing edge attachment for a turbine airfoil, comprising: a generally elongated body having a suction side surface and a pressure side surface; a suction side securement device positioned in the generally elongated body proximate to the suction side surface of the generally elongated body and adapted to receive an outer wall of the turbine airfoil forming a suction side surface of the turbine airfoil; a pressure side securement device positioned in the generally elongated body proximate to the pressure side surface of the generally elongated body and adapted to receive an outer wall of the turbine airfoil forming a pressure side surface of the turbine airfoil; and an attachment device adapted to attach the generally elongated body to the turbine airfoil.

10. The trailing edge attachment of claim 9, wherein the suction side securement device comprises a spanwise cavity extending chordwise into the generally elongated body, wherein a distance from the suction side surface of the airfoil to the pressure side surface of the airfoil is greater than a distance from an outermost inlet surface of the suction side securement device of the generally elongated body to an outermost inlet surface of the pressure side securement device of the generally elongated body.

11. The trailing edge attachment of claim 10, wherein the pressure side securement device comprises a spanwise cavity extending chordwise into the generally elongated body.

12. The trailing edge attachment of claim 9, wherein the pressure side securement device comprises a cavity extending into the generally elongated body, wherein a distance from the suction side surface of the airfoil to the pressure side surface of the airfoil is greater than a distance from an outermost inlet surface of the suction side securement device of the generally elongated body to an outermost inlet surface of the pressure side securement device of the generally elongated body.

13. The trailing edge attachment of claim 9, wherein the attachment device includes a plurality of pins that extend through a portion of the generally elongated body and into the turbine airfoil.

14. The trailing edge attachment of claim 9, further comprising a cooling system positioned in the generally elongated body.

15. The trailing edge attachment of claim 14, wherein the cooling system comprises a plurality of cooling channels extending from the leading edge of the generally elongated body to a trailing edge of the trailing edge attachment.

16. The trailing edge attachment of claim 9, wherein a leading edge of the generally elongated body includes an elongated cavity defining the leading edge of the body, wherein the elongated cavity is adapted to receive cooling fluids from the airfoil.

17. A method for attaching a trailing edge attachment to a composite turbine airfoil, comprising: providing a composite turbine airfoil having a leading edge, a pressure side surface, a suction side surface, and a trailing edge; providing a trailing edge attachment formed from a generally elongated body having a suction side surface adapted to be positioned flush with a suction side surface of a turbine airfoil, a pressure side surface adapted to be positioned flush with a pressure side surface of the turbine airfoil, a leading edge of the body formed by an elongated cavity defining the leading edge of the body, wherein the elongated spanwise cavity is configured to receive at least a portion of the turbine airfoil, and an attachment device adapted to attach the generally elongated body to the turbine airfoil; inserting the trailing edge of the composite turbine airfoil into the elongated cavity in the leading edge of the trailing edge attachment; and attaching the trailing edge attachment to the composite turbine airfoil.

18. The method of claim 17, wherein attaching the trailing edge attachment to the composite turbine airfoil comprises inserting a plurality of pins through the pressure side surface of the trailing edge and into the airfoil and inserting a plurality of pins through the suction side surface of the trailing edge and into the airfoil.

19. The method of claim 17, wherein attaching the trailing edge attachment to the composite turbine airfoil comprises inserting a plurality of pins through the pressure side surface of the trailing edge, into the airfoil, and into an attachment support positioned within a cavity in the turbine airfoil and proximate to an outer wall of the turbine airfoil, and inserting a plurality of pins through the suction side surface of the trailing edge, into the airfoil, and into the attachment support positioned within the cavity in the turbine airfoil and proximate to an outer wall of the turbine airfoil.

* * * * *